US009856610B2

(12) United States Patent
Sylvester

(10) Patent No.: US 9,856,610 B2
(45) **Date of Patent: *Jan. 2, 2018**

(54) APPARATUS AND METHOD FOR SERVICING PAVEMENT

(71) Applicant: Integrated Roadways, LLC, Kansas City, MO (US)

(72) Inventor: Tim Sylvester, Raytown, MO (US)

(73) Assignee: Integrated Roadways, LLC, Kansas City, MO (US)

( * ) Notice: Subject to any disclaimer, the term of this patent is extended or adjusted under 35 U.S.C. 154(b) by 58 days.

This patent is subject to a terminal disclaimer.

(21) Appl. No.: 15/084,778

(22) Filed: Mar. 30, 2016

(65) Prior Publication Data

US 2016/0222594 A1 Aug. 4, 2016

Related U.S. Application Data

(63) Continuation of application No. 14/383,080, filed as application No. PCT/US2013/029992 on Mar. 8, 2013, now Pat. No. 9,340,930.

(60) Provisional application No. 61/608,517, filed on Mar. 8, 2012.

(51) Int. Cl.

| | |
|---|---|
| ***E01C 5/06*** | (2006.01) |
| ***E01C 9/00*** | (2006.01) |
| ***E01C 11/00*** | (2006.01) |
| ***E01C 5/00*** | (2006.01) |
| ***E01C 5/16*** | (2006.01) |
| ***E01C 11/16*** | (2006.01) |

(52) U.S. Cl.

CPC ..... *E01C 5/06* (2013.01); *E01C 5/00* (2013.01); *E01C 5/16* (2013.01); *E01C 9/00* (2013.01); *E01C 11/00* (2013.01); *E01C 11/005* (2013.01); *E01C 11/16* (2013.01)

(58) Field of Classification Search

CPC ..... E01C 5/00; E01C 5/06; E01C 5/16; E01C 11/00; E01C 11/16; E01C 11/005; E01C 9/00; E02D 27/38; E02D 27/32; E02D 27/01

See application file for complete search history.

(56) References Cited

U.S. PATENT DOCUMENTS 3,534,668 A * 10/1970 Scheinoha ..... E01C 5/08 404/45
4,000,591 A * 1/1977 Courtois ..... B28B 23/005 52/125.4
5,586,834 A * 12/1996 Tsuji ..... E01C 11/14 404/60
5,626,289 A * 5/1997 Demers, Jr. ..... E01C 9/04 238/8

(Continued)

*Primary Examiner* — Abigail A Risic
(74) *Attorney, Agent, or Firm* — Hovey Williams LLP

(57) ABSTRACT

A removable and serviceable paving apparatus including an access port for providing access to the interior of the slab. The access port is operable to improve access to components of the paving system prior to, during, and/or after installation. The paving apparatus further includes a removable fastener for improving removability and serviceability. The removable fastener attaches the paving apparatus to its neighboring structures to form a paving surface, may be disengaged from the neighboring structures for removal, repair and/or service of the paving apparatus, and may be re-engaged upon re-installation of the paving apparatus.

21 Claims, 7 Drawing Sheets

(56) References Cited

U.S. PATENT DOCUMENTS

| | | | | |
|---|---|---|---|---|
| 6,389,774 | B1 * | 5/2002 | Carpenter | E01C 11/14 404/52 |
| 6,607,329 | B2 * | 8/2003 | Smith | E01C 5/08 404/17 |
| 6,709,192 | B2 * | 3/2004 | Smith | E01C 5/08 404/17 |
| 6,758,023 | B1 * | 7/2004 | Sorkin | E04B 1/483 52/583.1 |
| 7,134,805 | B2 * | 11/2006 | Yee | F16L 13/113 403/381 |
| 8,118,519 | B2 * | 2/2012 | Happel | F16B 13/124 405/135 |
| 2003/0231929 | A1 * | 12/2003 | Lee | E01C 5/06 404/34 |
| 2006/0034654 | A1 * | 2/2006 | Sanders | E01C 5/08 404/40 |
| 2009/0116906 | A1 * | 5/2009 | Kaylor | E01C 5/08 404/75 |
| 2009/0320386 | A1 * | 12/2009 | Mackay Sim | B28B 7/002 52/125.4 |
| 2011/0277547 | A1 * | 11/2011 | Duncan | G01N 27/048 73/335.02 |
| 2013/0115000 | A1 * | 5/2013 | Smith | E01C 11/02 404/40 |
| 2013/0183091 | A1 * | 7/2013 | Navarro Buitrago | E01C 9/00 404/34 |
| 2014/0260570 | A1 * | 9/2014 | Ranwell | G01N 33/383 73/73 |
| 2014/0270947 | A1 * | 9/2014 | Ulislam | E01O 5/005 404/40 |

* cited by examiner

APPARATUS AND METHOD FOR SERVICING PAVEMENT

CROSS-REFERENCE TO RELATED APPLICATION

The present application is a continuation of co-pending, identically-titled U.S. patent application Ser. No. 14/383,080 filed Sep. 4, 2014; which is the United States National Stage Application of Patent Cooperation Treaty Application No. PCT/US13/29992, filed Mar. 8, 2013, and entitled PRECAST REMOVABLE PAVING SLABS; which claims the benefit of U.S. Provisional Application Ser. No. 61/608,517, filed Mar. 8, 2012, and entitled PRECAST REMOVABLE PAVING SLABS; the entirety of each of the foregoing prior-filed applications is hereby incorporated herein by reference, to the extent permitted by law.

BACKGROUND OF THE INVENTION

1. Field

The present invention pertains to an apparatus and method for servicing pavement. The invention more particularly concerns an improved modular, removable, and serviceable paving apparatus and a method for servicing same.

2. Discussion of Related Art

Existing pavement systems fall into two broad categories: precast systems or poured continuous systems. The precast systems incorporate various permanent means of connecting the sections, including extensive grouting and permanent extended connecting members that run between the sections. Some incorporate post-tension tendons running through the sections that are permanently grouted to fix the sections together. Poured continuous systems have many similarities, and incorporate permanent connecting members between cuts formed in the pavement.

Existing pavement systems are not designed with means to access the interior of the pavement, nor components which may be embedded in the pavement. This significantly inhibits the ability to install and service the pavement, and to develop new technologies for deployment in the pavement. Further, existing pavement systems are not designed to be removable and serviceable. Removal and replacement of existing pavement is expensive and time consuming. The present inventive concept addresses these shortcomings of existing pavement systems.

BRIEF SUMMARY OF THE INVENTION

The present inventive concept provides a modular, removable and serviceable paving apparatus. The paving apparatus includes a slab, preferably including an internal reinforcement system such as a steel rebar grid. The slab has an access port configured to provide access to the interior portion of the slab. A receiver is at least partially embedded in the slab and is configured to be a point at which a significant amount of force can be applied without damaging the slab. Preferably, the receiver, which in a preferred embodiment comprises a lift lug, is secured to the internal reinforcement system of the slab to provide greater stability and is also secured to the access port.

The paving apparatus is particularly well-suited to house sensors and sensor networks that may be at least partially embedded in and/or accessible via the access port. The access port or ports may be protected following installation by removable plugs. The access port may further provide access to a grouting port for targeted placement of grouting or similar materials on the underside of the slab in connection with installation or repair efforts.

The removable paving apparatus may further include a lift bolt removably attached to the receiver. The lift bolt is used to provide a secure connection for lifting means to interact with the paving apparatus. The lift bolt may have a head with an integrated flange having an aperture for connecting with the lifting means, or may be used to secure a separate flange to the body of the slab, where the separate flange has an aperture or similar connecting mechanism for attachment to the lifting means. The lift bolt may further include a grouting port running through its shaft for fluid communication between the access port and the underside of the slab.

The paving apparatus further enhances serviceability in an embodiment by including means to removably couple the slab to a neighboring receiving structure. The means include a removable fastener extending horizontally through a cavity running perpendicular to, and intersecting with, an access port. In a preferred embodiment, the removable/retractable fastener is a dowel bar. The removable/retractable dowel may lie within the main body of the slab during and after installation. The dowel bar is machined to have teeth or thread on its outer surface for engaging bolts that drive it to move horizontally in the cavity and/or that arrest such movement. The bolts include drive bolt(s) and stop bolt(s). These bolts may extend through the access port to engage the dowel bar, and the stop bolt may further have thread on the outer surface of its shaft for engaging the thread on the inner surface of the receiver.

During installation of a preferred embodiment, the drive bolt engages the dowel bar to extend it from a first side of the slab. The dowel bar is received by a mating connector of a receiving structure. Once the dowel bar is correctly positioned, the drive bolt is removed and replaced with a stop bolt which engages the dowel bar at its teeth or thread. The stop bolt is secured from rotation, thus preventing horizontal movement of the dowel bar. For removal, the stop bolt is replaced with the drive bolt which is driven to retract the dowel bar into the body of the slab. The mating connector may include an epoxy or rubber compression fit for securely but removably receiving the dowel bar.

The foregoing are intended to be illustrative of the invention and are not meant in a limiting sense. Many possible embodiments of the invention may be made and will be readily evident upon a study of the following specification and accompanying drawings comprising a part thereof. Various features and sub-combinations of invention may be employed without reference to other features and sub-combinations.

BRIEF DESCRIPTION OF THE DRAWINGS

Embodiments of the present inventive concept are described in detail below with reference to the attached drawing figures, wherein.

Figure 1A:
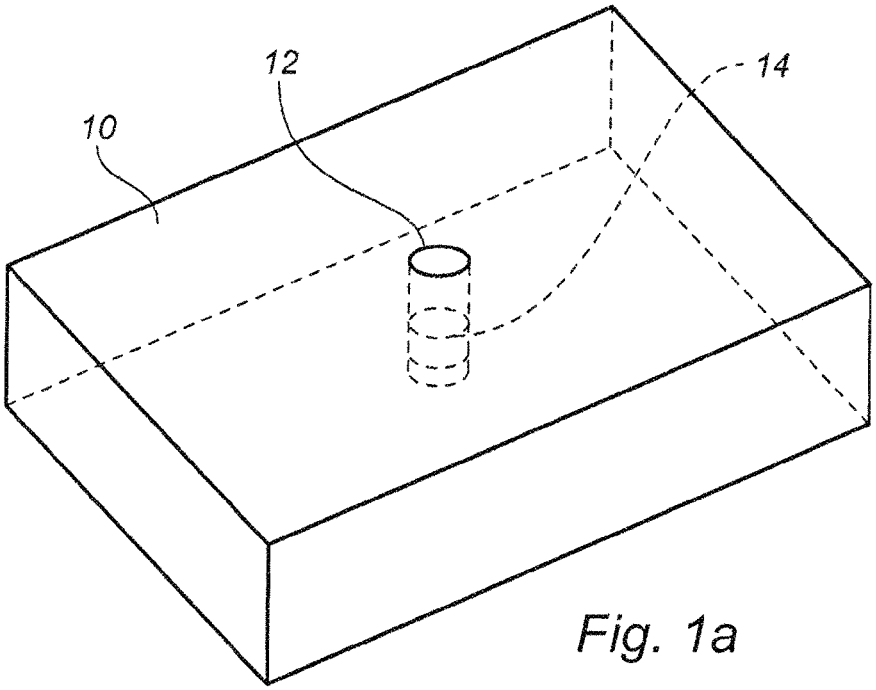
FIG. 1*a* is an elevated and partially rotated view of an aspect of the present inventive concept illustrating a paving slab with a single access port at the slab's center of mass having a lift lug embedded within the access port.

The drawing figures do not limit the present inventive concept to the specific embodiments disclosed and described herein. The drawings are not necessarily to scale, emphasis instead being placed upon clearly illustrating the principles of the present inventive concept.

DETAILED DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to FIGS. 1-7, an apparatus and method for servicing pavement is disclosed. Existing pavement is designed to maximize durability against wear and tear, and to minimize the need for maintenance and servicing. However, existing pavement structures fail to provide an adequately serviceable paving system. The present inventive concept includes a modular slab apparatus with features designed to improve the serviceability of the slab and its associated components, and to improve the overall serviceability of a paving system. In another aspect of the present inventive concept, an apparatus is disclosed that is versatile enough to cooperatively engage a variety of existing receiving structures, thereby further enhancing the overall serviceability of a paving system. Still further, the present inventive concept's pre-fabricated modular slabs may be of single-lane width, including when used in multi-lane applications, thus allowing more targeted slab removal for repair and/or utility access which can decrease associated costs. The modular paving apparatus may be formed in a variety of shapes depending on the demands of the installation site and the shapes of the neighboring structures.

Figure 1B:
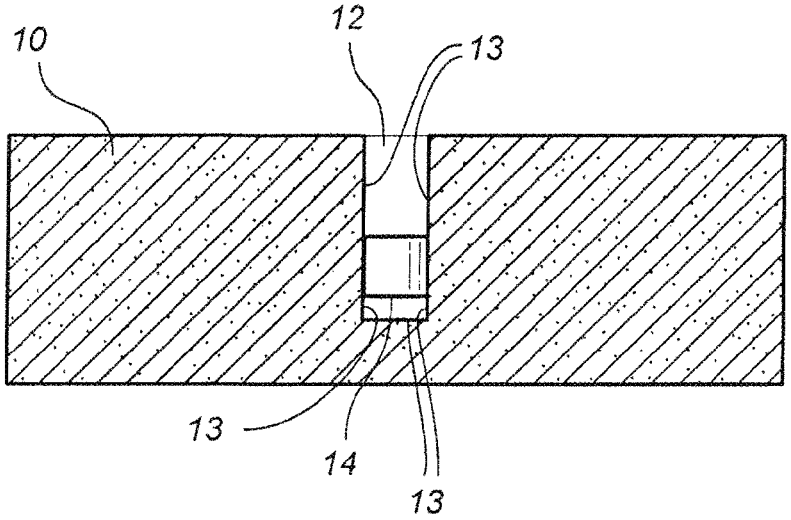
FIG. 1*b* is a cross-sectional view of a portion of the paving slab of FIG. 1*a;*

Turning now to FIGS. 1*a* and 1*b*, a pre-cast, pre-stressed concrete slab 10 incorporating prestress tendons (not shown) is illustrated with a single access port 12 located at the center of mass of the slab 10. The main body of the slab 10 may alternatively be composed of reinforced (or unreinforced) geopolymer, plastic, hollowcore, fiberglass, carbon fiber, foamed concrete, pervious concrete or similar material, or other suitable materials. The paving apparatus may further include an internal reinforcement system (not shown) such as, for example, a series of alternating layers of steel rebar or fiberglass or carbon fiber reinforcement materials embedded within the concrete. The internal reinforcement system improves the ductility and/or tensile strength of the paving apparatus. The paving apparatus further includes a receiver embedded in the slab 10 and accessible via the access port 12.

The access port 12 is a hollow formed in the slab 10. The paving apparatus may further include a lining for walls 13 of the access port 12, and the walls 13 may be poured or otherwise formed in desired configurations, as necessary or appropriate to facilitate seating one or more components (such as sensor(s) 16) within the access port 12 and/or to resist the migration of substances from the surrounding slab 10 into the access port 12. The access port 12 may provide sustained access to crucial components of the paving system, even after installation of the paving apparatus, while minimizing internal voids, pockets and/or surface discontinuities. The access port 12 thus improves serviceability of the paving apparatus and of the paving system as an integrated whole. Preferably, each access port 12 will be located so as to better balance the slab when lifted (in applications where the access port(s) provide access to the receiver 14) by a lifting means such as a crane machine seated on a truck bed, and so as to avoid primary tire lanes.

Figure 2A:
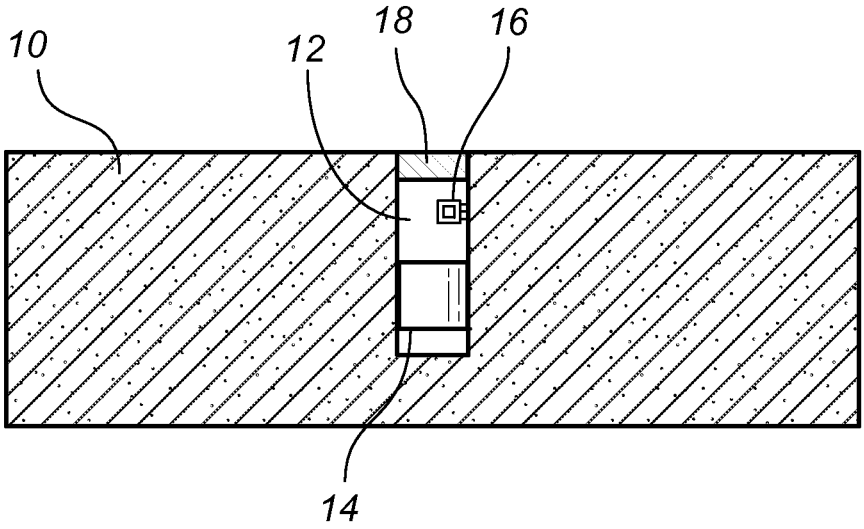
FIG. 2*a* is a cross-sectional view of an aspect of the present inventive concept illustrating an access port with lift lug and a sensor.

Turning now to FIG. 2*a*, a paving apparatus is illustrated including a slab 10 and a centrally-located access port 12 as well as a receiver 14 accessible through the access port 12. The paving apparatus further includes a sensor 16 of the paving system accessible via the access port 12. Sensor 16 is shown as housed within the access port 12, but in other embodiments may be only partially housed within the access port 12. The paving apparatus further includes a removable plug 18 for at least partially sealing the access port 12 when access is not needed and protecting the access port 12 and the components it houses from exposure to the elements.

The sensor 16 may serve any of a variety of functions, for example it may detect deflection, acceleration, vehicle presence, GPS location, traffic patterns, relative motion, void development, water intrusion, chloride concentration, incremental and accumulated stress and strain, wireless networking, communication, backhaul, power provision, metering, charging, generation, and scavenging, or serve other such functions. An embodiment of the present inventive concept may further include a sensor network including embedded sensors, permanent sensors, and/or removable, replaceable sensors. Power access for embedded sensors may be provided via an access port, and removable sensors may be installed in the removable plug that seals an access port or on the stop bolt in the installed configuration. The embedded sensor networks may be connected via wired and/or wireless links and may be equipped with a high bandwidth multipoint connection. The data generated by the sensor network may comprise pavement condition information, real-time traffic, dynamic signaling, vehicle to vehicle coordination, safety and emergency communications, automatic accident reporting with the capability for virtual playback, as well as automated location-based advertising and related data that travelers may directly or indirectly trigger.

An advantage of embedded sensors according to embodiments of the present invention is that they can provide many new types of data to the pavement owner.

Another advantage of embedded sensors according to embodiments of the present invention is that it may reduce labor costs associated with assessment of pavement quality.

A sensor may be embedded, permanent, removable, and/or replaceable, and may be installed in a removable plug that seals the access port and/or may be replaced from an inclusion within the slab. Some sensors may be permanently built into slabs. However, an advantage of embodiments of the system is that some shorter-lived sensors can be moved to replaceable locations. Once slabs according to embodiments of the system are used, it may be relatively inexpensive to add new sensor capabilities to the pavement. Some sensors may be exchanged either through replacing the slab and changing the sensor in the factory, or by field-removable means.

Embodiments of the invention may include a deflection sensor to measure pavement response to loading, or a void sensor network to locate any potholes, washout, or other voids developing in the base.

Embodiments of the invention may further include sensor(s) to: detect any acceleration or relative motion of the slab in relation to its expected position (shifting or creeping) and/or the immediate presence and/or speed of a vehicle load to monitor traffic presence and patterns; to enable vehicle self-navigation; and/or to allow dynamic alteration of traffic signals in response to real time traffic loads. Embodiments of the invention may further include sensor(s) such as GPS locators to determine a slab's physical location relative to its neighbor slabs and any traffic or other bearing on the surface of the slab, hygrometers to measure water presence, and/or scavenging systems such as piezoelectric crystals, as well as to provide system power access such as to batteries and regulators and/or access to networking components to record such information and transmit it to a local recording device or distally to a monitoring station.

Figure 2B:
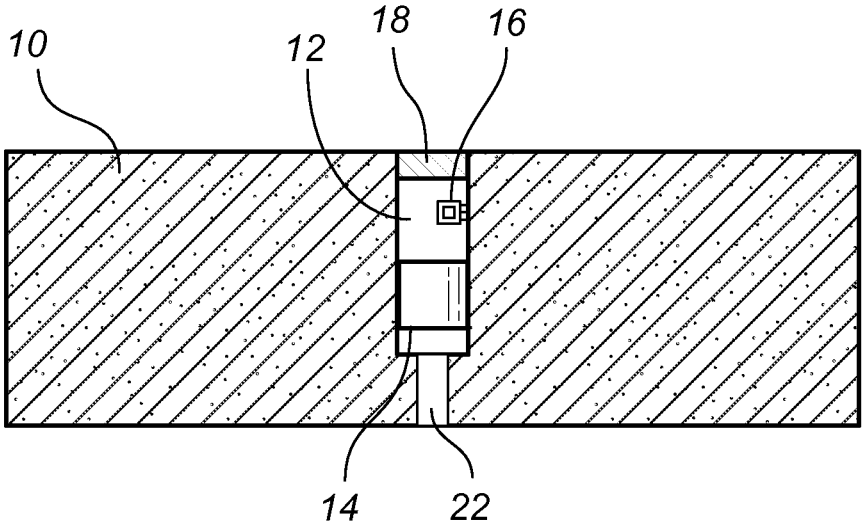
FIG. 2*b* is a cross-sectional view of an aspect of the present inventive concept illustrating an access port with lift lug, sensor and a grouting port.
Figure 3:
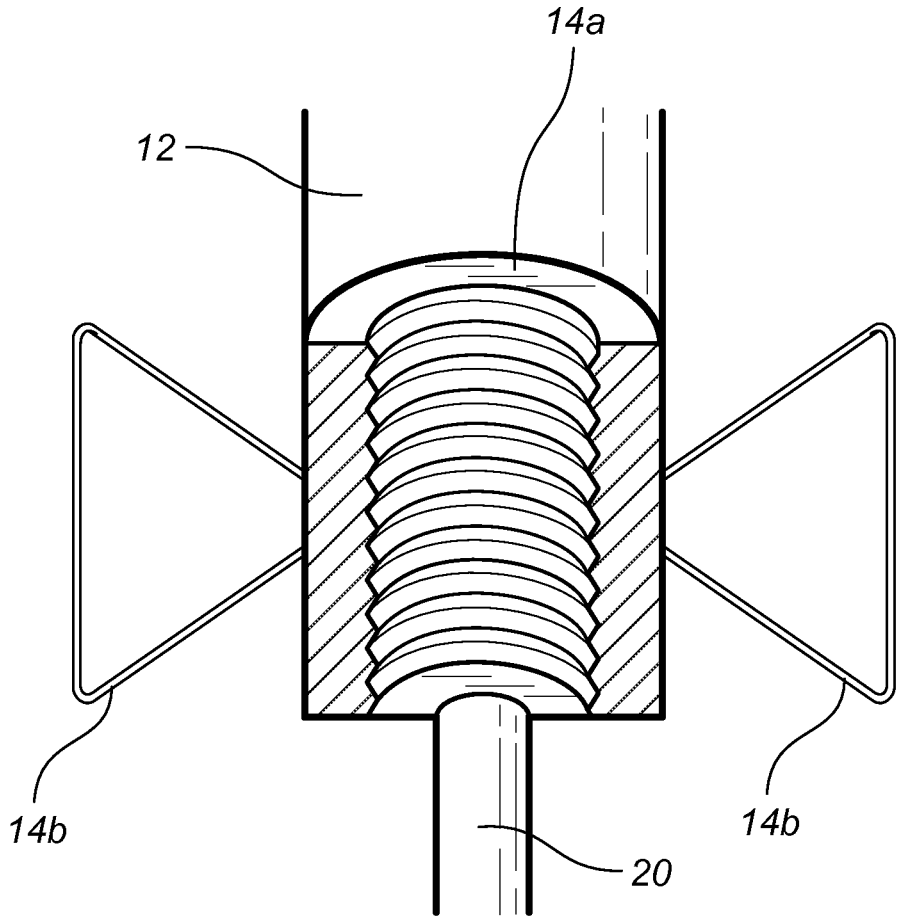
FIG. 3 is a detailed cross-sectional view of an aspect of the present inventive concept illustrating a partial view of the access port with a threaded lift lug for receiving, inter alia, a lift bolt (not shown) and having legs for attachment to a reinforcement system (not shown)

FIG. 2*b* further illustrates an aspect of the present inventive concept including a grouting port 20 providing fluid communication to the bottom of the slab 10 via the access port 12. In the preferred embodiment of FIG. 2*b*, the grouting port 20 is configured to receive fluid, for example, grouting, that may flow through the access port 20 or, preferably, through tubing (not shown) inserted through the access port 20. Preferably, the receiver 14 will include a channel or tubing through which such fluids may flow. FIG. 3 illustrates such a channel running through the center of a receiver 14, represented as a lift lug in this embodiment, according to the present inventive concept. The lift lug 14 is configured similarly to a lug known in the art as an F-47 style lug, and includes a cylinder 14*a* with thread on its interior surface for engaging various bolts and other structures inserted through the access port 12 or other cavity that houses the lift lug 14. The lift lug 14 is preferably set within the slab 10 prior to pouring the concrete that makes up the slab 10's main body, and further includes legs 14*b*, illustrated in the embodiment of FIG. 3 in the configuration of butterfly wings, which extend into the surrounding slab 10 and preferably are fixed to the internal reinforcement system for enhancing the distribution of force during lifting. The lift lug 14 may be of different design and employ different means of securing itself to the paving apparatus and/or components with which it operatively couples without departing from the spirit of the present inventive concept.

Figure 4A:
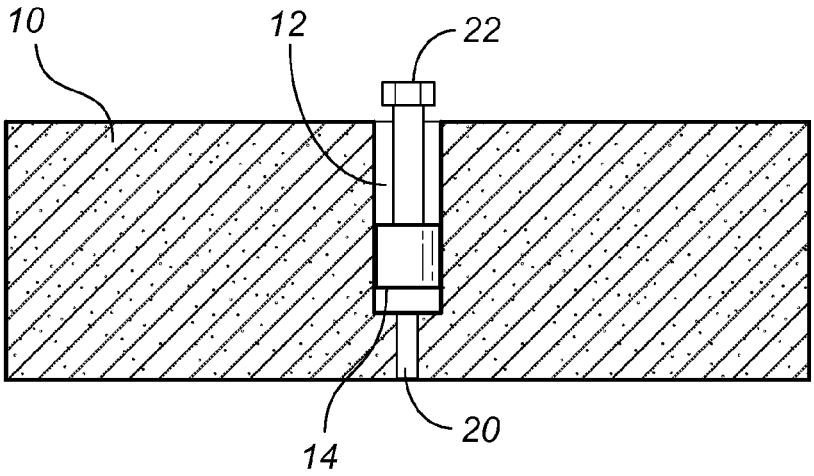
FIG. 4*a* is a cross-sectional view of an aspect of the present inventive concept illustrating an access port with a lift bolt removably attached to a lift lug.
Figure 4B:
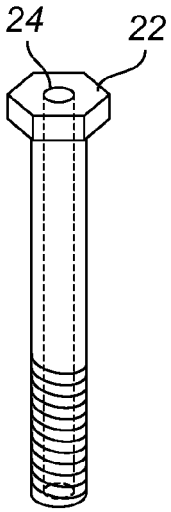
FIG. 4*b* is an elevated view of a lift bolt of the present inventive concept that includes a lift bolt grouting port for delivering grouting to a bottom of a slab.

Turning now to FIG. 4*a*, an aspect of the present inventive concept is illustrated having a lift bolt 22 removably coupled to the receiver 14. The lift bolt 22 extends from the receiver 14 through the access port 12 toward the top of the slab 10. FIG. 4*b* illustrates a preferred embodiment of the lift bolt 22 that further includes a lift bolt grouting port 24 extending from the head of the lift bolt 22 through its main body and providing fluid communication with the grouting port 20. Using the lift bolt grouting port 24 during installation of the paving apparatus, installers are able to selectively apply grouting to the underside of the paving apparatus through the one or more receivers 14, for example to fill voids and imperfections in the underlying paving bed or to adjust the relative height of portions of the paving apparatus for better surface flow and grading, and/or alignment with surrounding receiving structures. The bottom surface of the slab 10 may have channels formed in it to facilitate grouting and leveling of the slab 10.

Figure 4C:
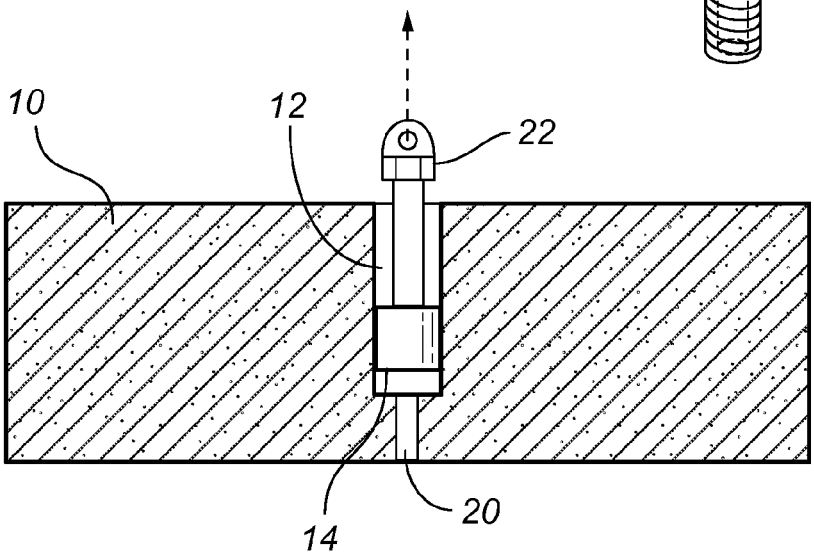
FIG. 4*c* is a cross-sectional view of an aspect of the present inventive concept illustrating an access port with a lift bolt having an aperture for attachment to a lifting means.

FIG. 4*c* illustrates an aspect of the present inventive concept including a lift bolt 22 having an integrated aperture on its head for attachment to a lifting means, such as a mobile crane seated on a truck bed or on ground near the installation site. The lift bolt 22 may alternatively be inserted through a flange having an aperture at the top of the slab 10, and the lift bolt 22 may be screwed into the receiver 14 to secure the flange to the slab 10, thereby providing a secure, temporary, structure for attachment to the lifting means. Alternative means of providing an aperture or similar means for attaching the lift bolt 22 to the lifting means may be employed without departing from the spirit of the invention.

Figure 5:
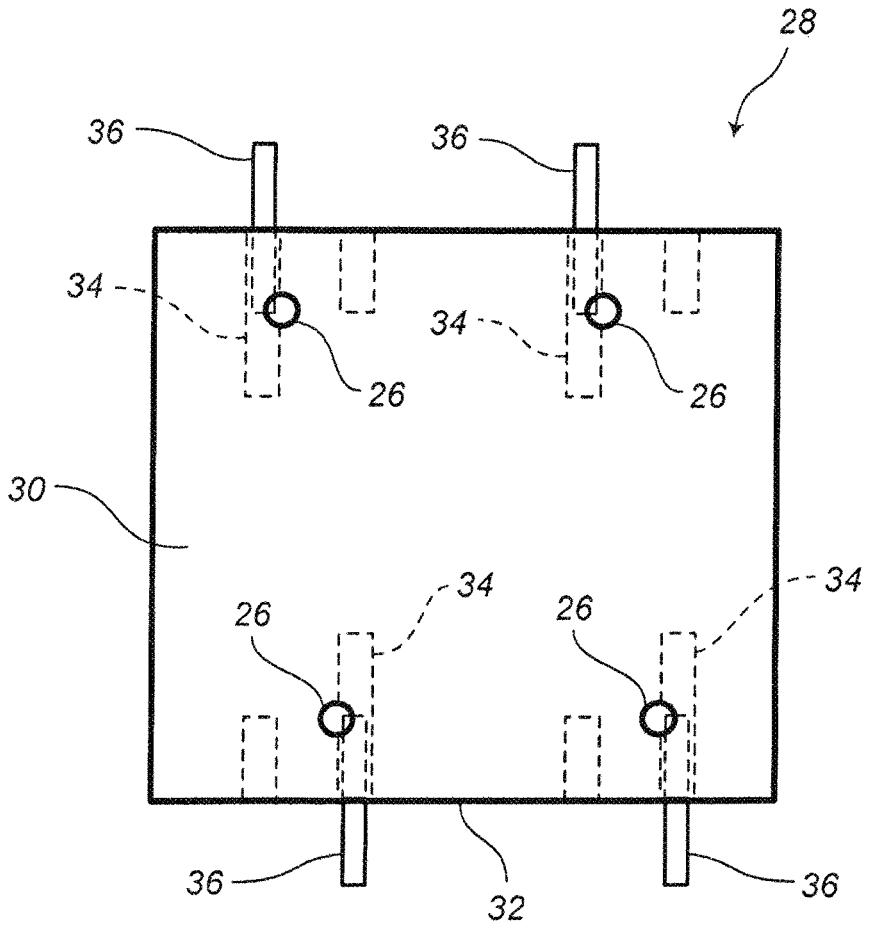
FIG. 5 is a top view of an aspect of the present inventive concept illustrating a slab and four access ports intersecting with two pairs of horizontal cavities, each of the pairs respectively extends to one of two side surfaces of the slab and houses partially deployed removable fasteners.

FIG. 5 illustrates a top perspective view of an aspect of the present inventive concept including four access ports 26 with openings spaced across the top surface of paving apparatus 28. This paving apparatus' 28 access ports 26 are similarly spaced across paving slab 30 at locations allowing for balanced lifting of the paving apparatus via the receivers (not pictured) accessible at the access ports 26. The access ports 26 are also distributed, and this paving apparatus 28 is configured, to optionally be part of a system of similarly-shaped and configured pavement apparatuses attachable to one another. The slab 30 of the paving apparatus has a first side 32, and two cavities 34 that originate in the body of the slab and extend horizontally toward the first side 32 of the slab 30, intersect perpendicularly to two of the access ports 26, and terminate in openings in the first side 32. An identical, but offset, pair of cavities 34 extend toward and terminate at the opposite side of the slab 30. Each of these four cavities 34 houses a removable fastener 36 configured to attach to a neighboring receiving structure (not shown) and permit load transfer between the paving apparatus 28 and such neighboring receiving structure. In a preferred embodiment, the neighboring receiving structure is identical to the paving apparatus 28 illustrated in FIG. 5, and thus when the first side 32 of the paving apparatus 28 is aligned with the opposite side of a neighboring paving apparatus, the removable fasteners 36 protruding from the first side 32 will engage with and attach to the neighboring paving apparatus at cavities (no reference numeral shown). The receiving structure may employ alternative means of engaging the paving apparatus 28 without departing from the spirit of the present inventive concept. Further, a paving apparatus may engage receiving structure(s) on one or multiple of its sides without departing from the spirit of the present inventive concept.

Figure 6:
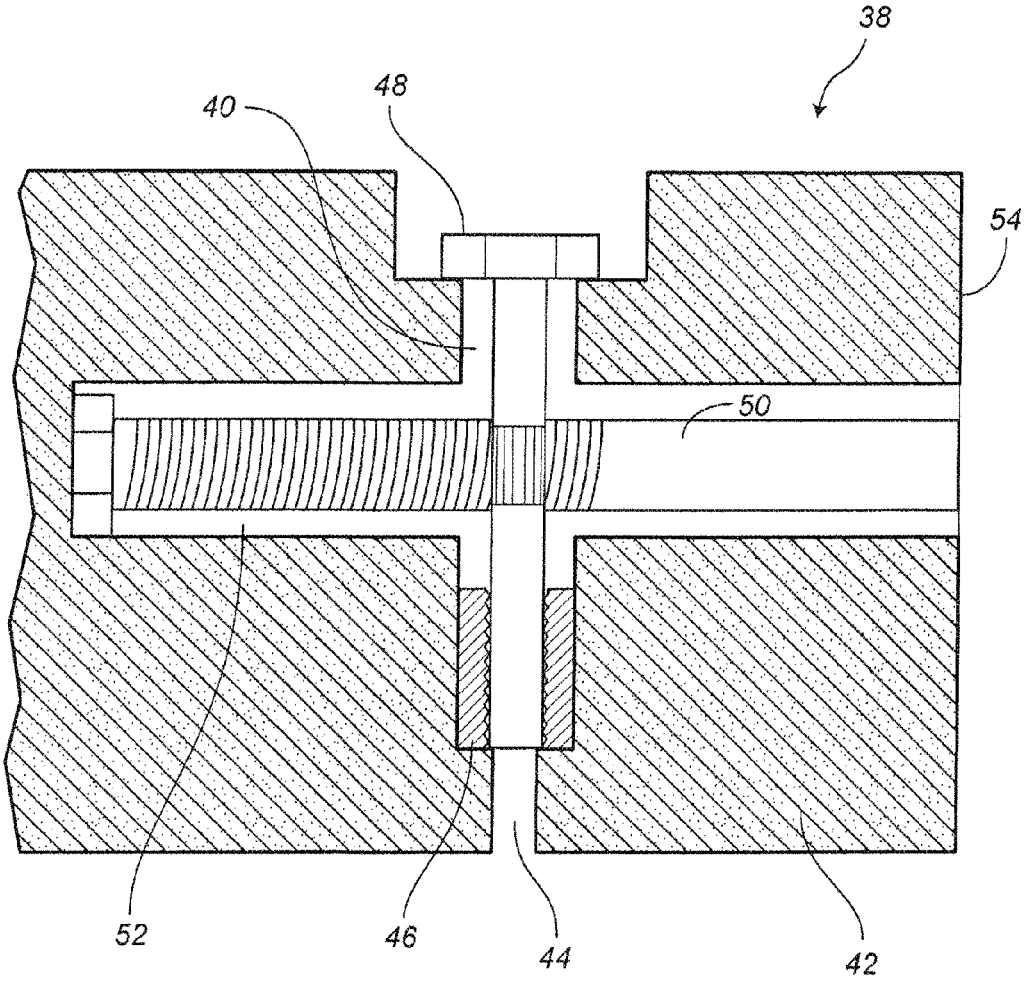
FIG. 6 is a cross-sectional view of an aspect of the present inventive concept illustrating a retracted dowel bar removable fastener operably coupled to a drive bolt that extends through the access port.

FIG. 6 illustrates a preferred embodiment of a paving apparatus 38 according to an aspect of the present inventive concept including an access port 40 extending vertically through slab 42 and terminating at a grouting port 44. A receiver 46 is illustrated as a lift lug embedded in the access port 40 adjacent to the internal opening of the grouting port 44. The access port 40 terminates at the opposite end near the top of the slab 42 at an opening to a widened plug cavity configured to receive a removable plug (not shown). At the opening to the widened plug cavity is the head of a rotatable drive bolt 48 extending from the widened plug cavity into the access port 40 and terminating adjacent to, and preferably in the internal cavity of, receiver 46. The drive bolt 48 includes teeth machined into the outer surface of its shaft. A removable fastener 50, which includes a dowel bar in the preferred embodiment of FIG. 6, extends perpendicular to the drive bolt 48 through cavity 52 toward first side 54, and is machined to include teeth or thread along the outer surface of its shaft. The teeth of the drive bolt 48 engage and couple with teeth or thread of the removable fastener 50 at the intersection of the cavity 52 and access port 40. The drive bolt 48 may be rotated to extend the removable fastener 50 so it protrudes from the first side 54 for attachment to the receiving structure, and may be rotated in the opposite direction to retract the removable fastener 50 into the body of the slab 42. The access port 40 shown in FIG. 6 enables access to removable dowel, lifting and grouting mechanisms—including, respectively, the horizontal cavity 52, lift lug 46 and grouting port 44—and is also referred to as a "combined access port".

Figure 7:
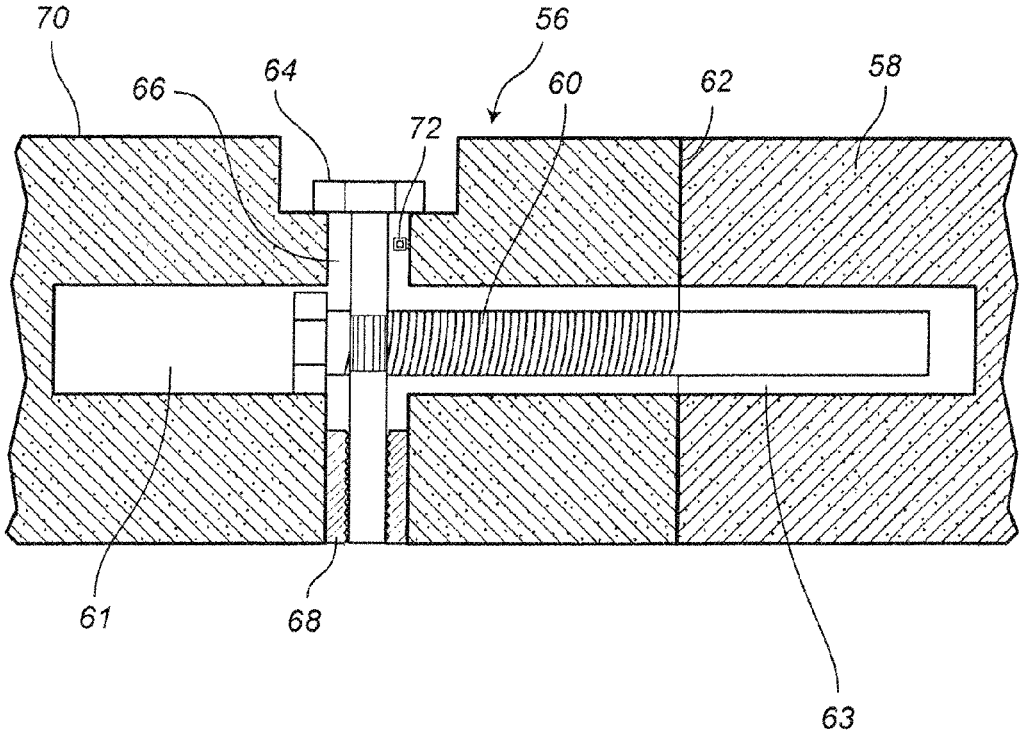
FIG. 7 is a cross-sectional view of an aspect of the present inventive concept illustrating an extended dowel bar operably coupled to a stop bolt and extending through a cavity through a first side of the slab and into a mating connector of a receiving structure.

FIG. 7 illustrates an aspect of the present inventive concept where a paving apparatus 56 has been installed and attached to a neighboring receiving structure 58. A drive bolt (not shown) has been used to move removable fastener 60 within cavity 61 and extend it from first side 62 into a mating connector 63 in the receiving structure 58, thereby attaching the paving apparatus 56 to said receiving structure 58 to allow the transfer of loads between them. The drive bolt has been replaced by a stop bolt 64 extending from the top opening of access port 66 through the access port 66 and terminating adjacent to receiver 68. In a preferred embodiment, the stop bolt 64 has thread on the outer surface of its shaft configured to engage complementary thread on the inner surface of the receiver 68. The outer surface of the stop bolt 64's shaft is further machined with thread or teeth to couple with and engage the teeth or thread of the removable fastener 60. The rotation of the stop bolt 64 is arrested through securing the stop bolt 64 by any of a variety of means, thereby preventing horizontal movement and retraction of the removable fastener 60. The rotation of the stop bolt 64 may be arrested by threading it through receiver 68 and allowing it to contact slab 70 or extend through to the ground (not shown) at the bottom of the slab 70. Additional rotation would be prevented by the contact with the slab 70 or ground. An alternative means of stopping rotation of the stop bolt 64 is to insert a press-fit rubber gasket into the access port 66. The paving apparatus 56 includes a sensor 72 and may also include a removable plug (not shown).

In a preferred embodiment, the removable fastener will be surrounded at least partially by a void control shroud that provides means for transferring force from the removable fastener to the walls of the cavity. An access port, grouting port and/or cavity may also be filled with grout following engagement of a slab with its receiving structure(s). In a preferred embodiment, and particularly in applications where the slab includes a partially-filled or shrouded cavity, the mating connector would further include a similar filling or shroud to serve similar purposes within the receiving structure. In one embodiment, the removable fastener is greased and epoxy is placed in the mating connector such that when the removable fastener is attached to the mating connector the epoxy provides a more distributed, and non-permanent, contact area. In another embodiment, the mating connector includes a rubber insert that acts as a press fit compression member for receiving the removable fastener. The rubber insert may be tapered and conical.

The slab of another embodiment may be surrounded by a material to facilitate joint sealing, force transfer, installation and removal. Suitable materials include rubber, plastic, or polymer compounds, such as a recycled tire product. These materials might form a 'compression garment' or 'bumper' around the slab. The material can extend the full depth of the slab and joint and exclude water by fitting tightly against its neighboring structures.

The paving apparatus of the present inventive concept is configured so as to improve efficient and repeatable maintenance and servicing. The present inventive concept further includes a method for servicing the paving apparatus. The method includes removing a removable plug adjacent to an access port, securing a lift bolt to a receiver embedded in a slab of the paving apparatus, securing a lifting means to the lift bolt, and engaging the lifting means to reposition the paving apparatus. In a preferred embodiment, the paving apparatus will be disengaged from a receiving structure prior to being repositioned. A removable fastener may be disengaged from a receiving structure by removing a stop bolt from the paving apparatus, coupling a drive bolt to the removable fastener, and driving the drive bolt to disengage the removable fastener from the receiving structure. Following repositioning, servicing and maintenance of the paving apparatus, in a preferred embodiment the paving apparatus will be returned to its original position, realigned with the receiving structure, and the removable fastener will be re-engaged to attach the paving apparatus to the receiving structure.

Having now described the features, discoveries and principles of the general inventive concept, the manner in which the general inventive concept is constructed and used, the characteristics of the construction, and advantageous, new and useful results obtained; the new and useful structures, devices, tools, elements, arrangements, parts and combinations, are set forth in the appended claims.

It is also to be understood that the following claims are intended to cover all of the generic and specific features of the general inventive concept herein described, and all statements of the scope of the general inventive concept which, as a matter of language, might be said to fall therebetween.

What is claimed is:

1. A paving apparatus comprising:

a slab having an access port extending into the slab; and a receiver at least partially embedded in the access port; wherein the access port is configured to provide access to a sensor; and a cavity extending substantially horizontally through the slab and terminating at a first side of the slab; and a removable fastener extending at least partially through the cavity;

wherein the access port is configured to provide access for mechanical engagement with the removable fastener at an intersection with the cavity during installation of the slab.

2. The paving apparatus of claim 1, wherein the access port is also configured to provide access to a grouting port during installation of the slab.

3. The paving apparatus of claim 2, wherein the grouting port extends at least partially through the slab and is configured to provide fluid communication with an underside of the slab during installation of the slab.

4. The paving apparatus of claim 2, wherein the grouting port is at least partly housed within a lift bolt configured to be secured to the receiver during installation of the slab.

5. The paving apparatus of claim 2, further comprising a grouting port, wherein the access port comprises a combined access port that intersects and provides access to the grouting port and the cavity during installation of the slab.

6. The paving apparatus of claim 1, wherein the sensor is configured to monitor at least one of (1) a physical condition of the slab and (2) the presence of vehicles on a top surface of the slab.

7. The paving apparatus of claim 1, wherein the removable fastener includes a dowel bar.

8. The paving apparatus of claim 1, further comprising at least one of (i) a filling and (ii) a shroud in the cavity following installation.

9. The paving apparatus of claim 1, wherein the access port is at least partially sealed following installation.

10. The paving apparatus of claim 9, wherein the access port is filled with grout.

11. The paving apparatus of claim 1, wherein the receiver is a lift lug.

12. The paving apparatus of claim 11, wherein the lift lug is secured to the access port.

13. The paving apparatus of claim 1, wherein the receiver comprises a lift lug having legs extending into a surrounding area of the slab.

14. The paving apparatus of claim 13, wherein the legs are fixed to an internal reinforcement system of the slab.

15. The paving apparatus of claim 6, wherein the sensor is configured to monitor the presence of vehicles on the top surface of the slab and is at least partially housed in the access port.

16. The paving apparatus of claim 15, wherein the sensor is embedded in a removable plug.

17. A paving apparatus comprising:

a slab having an access port extending into the slab;

a receiver at least partially embedded in the access port;

a cavity extending substantially horizontally through the slab and terminating at a first side of the slab;

a removable fastener extending at least partially through the cavity; and at least one of a stop bolt and a drive bolt configured to control horizontal movement of the removable fastener.

18. A method for installing a paving apparatus, the method comprising the steps of:

securing a crane to a receiver;

aligning the paving apparatus with a receiving structure; and engaging a removable fastener of the paving apparatus with the receiving structure;

wherein engaging the removable fastener with the receiving structure includes engaging the removable fastener with a drive bolt.

19. The method of claim 18, wherein the paving apparatus includes a cavity for housing the removable fastener, further comprising filling the cavity with a grout following installation.

20. A method for servicing a paving apparatus, the method comprising the steps of:

disengaging a removable fastener of the paving apparatus from a receiving structure; and securing a crane to a receiver;

wherein the crane is operable to permit repositioning of the paving apparatus, the step of disengaging the removable fastener includes removing a stop bolt from securement to the paving apparatus.

21. The method of claim 20, wherein the step of disengaging the removable fastener includes engaging the removable fastener with a drive bolt.

* * * * *